US011621500B2

(12) United States Patent
West et al.

(10) Patent No.: US 11,621,500 B2
(45) **Date of Patent: *Apr. 4, 2023**

(54) CIRCULARLY SYMMETRIC TIGHTLY COUPLED DIPOLE ARRAY

(71) Applicant: Rockwell Collins, Inc., Cedar Rapids, IA (US)

(72) Inventors: James B. West, Cedar Rapids, IA (US); Matilda G. Livadaru, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/411,813

(22) Filed: Aug. 25, 2021

(65) Prior Publication Data

US 2021/0384646 A1 Dec. 9, 2021

Related U.S. Application Data

(63) Continuation of application No. 15/972,608, filed on May 7, 2018, now Pat. No. 11,133,604.

(51) Int. Cl.

| | |
|---|---|
| ***H01Q 21/24*** | (2006.01) |
| ***H01Q 1/36*** | (2006.01) |
| ***H01Q 9/46*** | (2006.01) |
| ***H01Q 7/00*** | (2006.01) |
| ***H01Q 9/28*** | (2006.01) |
| ***H01Q 1/38*** | (2006.01) |

(52) U.S. Cl.

CPC ..... *H01Q 21/24* (2013.01); *H01Q 1/36* (2013.01); *H01Q 1/38* (2013.01); *H01Q 7/00* (2013.01); *H01Q 9/28* (2013.01); *H01Q 9/46* (2013.01)

(58) Field of Classification Search

CPC ..... H01Q 21/24; H01Q 1/36; H01Q 1/38; H01Q 7/00; H01Q 9/28; H01Q 9/46; H01Q 21/062; H01Q 21/20

See application file for complete search history.

(56) References Cited

U.S. PATENT DOCUMENTS

| | | | | |
|---|---|---|---|---|
| 5,838,282 | A | 11/1998 | Lalezari et al. | |
| 7,907,098 | B1 | 3/2011 | West | |
| 10,224,629 | B2 | 3/2019 | West | |
| 10,673,148 | B1 * | 6/2020 | West | H01Q 21/245 |
| 10,714,840 | B1 | 7/2020 | West et al. | |
| 10,811,787 | B1 | 10/2020 | West et al. | |
| 11,133,604 | B1 * | 9/2021 | West | H01Q 7/00 |
| 2003/0076274 | A1 | 4/2003 | Phelan et al. | |
| 2017/0040702 | A1 * | 2/2017 | West | H01Q 11/105 |
| 2017/0338558 | A1 | 11/2017 | West | |
| 2019/0103676 | A1 | 4/2019 | Sugimoto et al. | |

* cited by examiner

*Primary Examiner* — David E Lotter
(74) *Attorney, Agent, or Firm* — Suiter Swantz pc llo

(57) ABSTRACT

An antenna array includes a printed circuit board including printed circuit board elements circumferentially disposed at locations on a surface of the printed circuit board. The printed circuit board elements are disposed in opposing pairs at diametrically opposite locations and include a first member and a second member. The first member intersects the second member which is curved. The antenna array can be an ultra-ultra wide band (UUWB) wavelength scaled array (WSA) tightly coupled dipole array (TCDA) active electronically scanned array (AESA) aperture.

15 Claims, 4 Drawing Sheets

CIRCULARLY SYMMETRIC TIGHTLY COUPLED DIPOLE ARRAY

CROSS-REFERENCE TO RELATED APPLICATIONS

The present application is a continuation of U.S. patent application Ser. No. 15/972,608 and entitled CIRCULARLY SYMMETRIC TIGHTLY COUPLED DIPOLE ARRAY, filed May 7, 2018, which is incorporated herein by reference in its entirety.

BACKGROUND

Embodiments of inventive concepts disclosed herein relate generally to antenna arrays including but not limited to a tightly coupled dipole array.

Modern sensing and communication systems may utilize various types of antennas to provide a variety of functions, such as communication, radar, and sensing functions. For example, ultra-high frequency (UHF) and very high frequency (VHF) radio systems use directional and omnidirectional antenna arrays for data and voice communication. In another example, radar systems use antenna arrays to perform functions including but not limited to: sensing, intelligence-gathering (e.g., signals intelligence, or SIGINT), direction finding (DF), electronic countermeasure (ECM) or self-protection (ESP), electronic support (ES), electronic attack (EA) and the like. An ultra-ultra wide band (UUWB) Wavelength Scaled Array (WSA) Tightly Coupled Dipole Array (TCDA) Active Electronically Scanned Array (AESA) Aperture that has rotationally symmetric radiation properties in the far field radiating is difficult to achieve with conventional manufacturing techniques.

SUMMARY

In one aspect, embodiments of the inventive concepts disclosed herein are directed to an antenna array. The antenna array includes a substrate having a surface, first elements arranged about a first circumference about a center point on the surface of the substrate, and second elements arranged about a second circumference about the center point on the surface of the substrate. The first elements include a first member and a second member. The first member intersects the second member which is curved. The first circumference is smaller than the second circumference. The second elements include a third member and a fourth member. The third member intersects the fourth member which is curved.

In a further aspect, embodiments of the inventive concepts disclosed herein are directed to an antenna array. The antenna array includes a printed circuit board including printed circuit board elements circumferentially disposed at locations on a surface of the printed circuit board. The printed circuit board elements are disposed in opposing pairs at diametrically opposite locations and include a first member and a second member. The first member is linear and the second member is curved.

In a further aspect, embodiments of the inventive concepts disclosed herein are directed to a method of manufacturing an antenna array. The method includes providing a substrate, and providing at least four elements at locations along a circumference on the substrate. The at least four elements each include a first member and a second member. The second member is curved. The elements are disposed such that second members of the at least four elements effectively have linear polarization due to parasitic cross polarization cancellation.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or maybe represented schematically in the interest of clarity. Like reference numerals in the drawings may represent and refer to the same or similar element, feature, or function. In the drawings.

DETAILED DESCRIPTION

Figure 1:
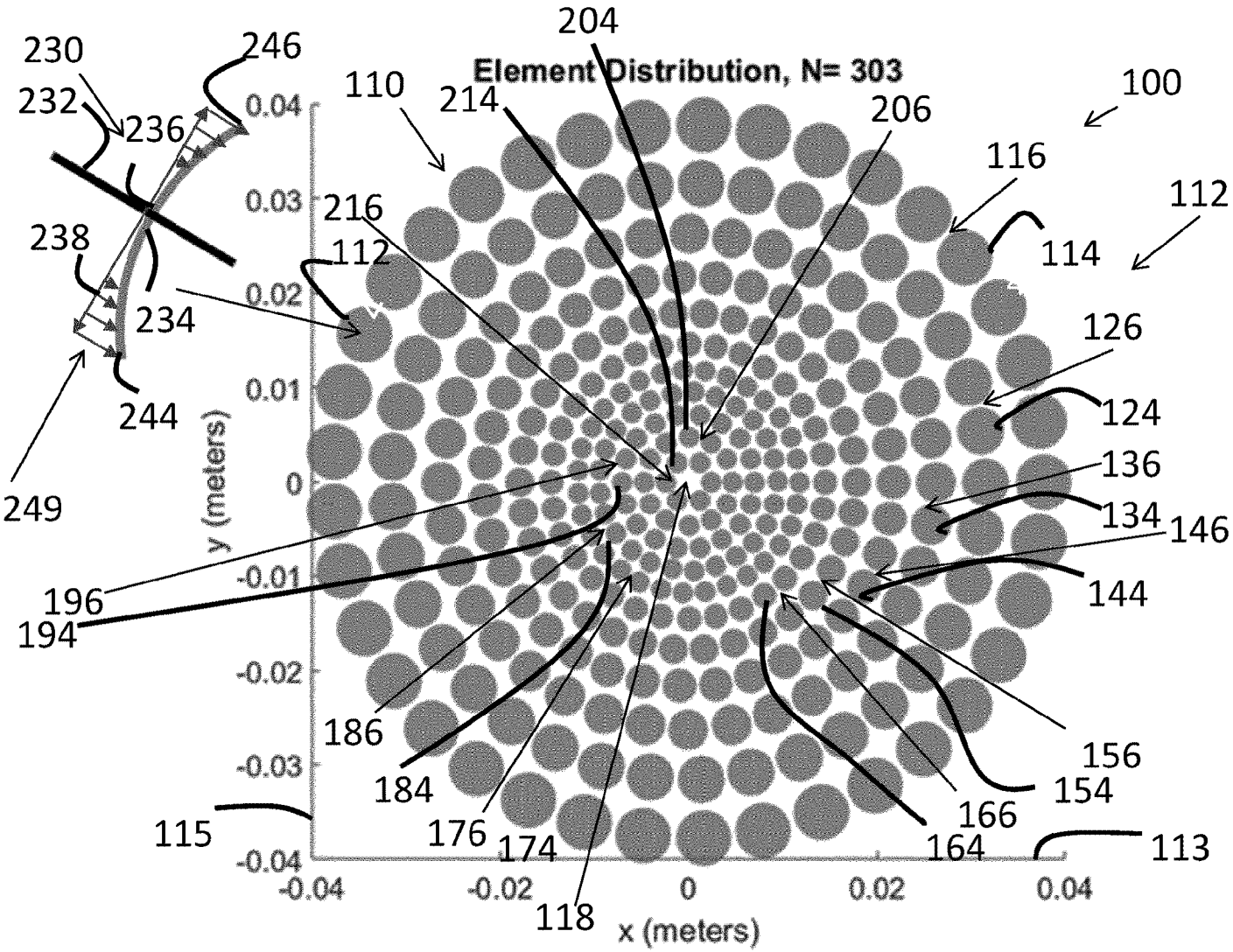
FIG. 1 is a top view schematic drawing of an antenna array according to exemplary aspects of the inventive concepts disclosed herein.

Before describing in detail embodiments of the inventive concepts disclosed herein, it should be observed that the inventive concepts disclosed herein include, but are not limited to a novel structural combination of components and circuits disclosed herein, and not to the particular detailed configurations thereof. Accordingly, the structure, methods, functions, control and arrangement of components and circuits have, for the most part, been illustrated in the drawings by readily understandable block representations and schematic diagrams, in order not to obscure the disclosure with structural details which will be readily apparent to those skilled in the art, having the benefit of the description herein. Further, the inventive concepts disclosed herein are not limited to the particular embodiments depicted in the diagrams provided in this disclosure, but should be construed in accordance with the language in the claims.

Some embodiments of the inventive concepts disclosed herein are directed to an aperture (e.g., a UUWB WSA TCDA AESA aperture) that has rotationally symmetric radiation properties in the far field radiating zone (e.g. beam width, gain, etc.). In some embodiments, the rotationally symmetric radiation properties of a directional antenna are attractive for RF sensor systems, such as a radar or other sensor. The UUWB aperture implementation realizes near constant radiation properties over very large bandwidths (e.g., greater than 10:1 instantaneous bandwidth (IBW)) in some embodiments. In some embodiments, the array provides UUWB performance for multifunction radio frequency (MFRF) type applications with high polarization purity. In some embodiments, the AESA array is utilized in UUWB signal intelligence (SIGINT) receiver systems and/or other advanced radio and radar systems.

In some embodiments, the aperture is provided in a configuration (e.g., with subarrays with uninterrupted element lattice spacing) that can be more easily manufactured. In some embodiments, the aperture is provided in a configuration (e.g., with subarrays with uninterrupted element lattice spacing implementation) that can be provided using tiles including antenna elements that are joined together. In some embodiments, the aperture is provided in a planar and/or conformal WSA UUWB TCDA aperture topology. The manufacturing techniques and configurations described in 17-CR-00515 (47141-1306), "Wavelength Scaled Array Layout Optimization", U. S. patent application Ser. No. 15/825711, and U.S. patent application Ser. No. 15/160959; each of the above listed applications are incorporated herein by reference in its entirety.

Referring to FIG. 1, an antenna system 100 for a communication, radar, or sensing system includes an antenna array 110 (e.g., a circularly shaped ESA array) of antenna elements 112. The antenna array 110 is provided on a substrate, such as, a printed circuit board substrate or other structure in some embodiments. In some embodiments, the antenna system 100 is for a sensing radar system or electronic warfare radar system.

In some embodiments, the antenna system 100 is a UUWB WSA TCDA AESA aperture. The antenna array 110 is shown on a Cartesian plane including an X-axis 113 and a Y-axis 115. The X axis 113 extends from a negative meter position to a positive meter position, and the Y-axis 115 extends from a negative meter position to a positive meter position. Although particular sizes are shown for the array 110 in FIG. 1, the sizes and dimensions are exemplary and other sizes and dimensions can be used depending upon system criteria and operational parameters. In some embodiments, the antenna array can have an X axis 113 that extends from a negative 0.4 meter position to a positive 0.4 meter position, and a Y-axis 115 that extends from a negative 0.4 meter position to a positive 0.4 meter position. In some embodiments, the antenna array can have an X axis 113 that extends from a negative 0.9 meter position to a positive 0.9 meter position, and a Y-axis 115 that extends from a negative 0.9 meter position to a positive 0.9 meter position.

As shown in FIG. 1, the antenna array 110 is formed of circumferentially disposed antenna elements 112 about a center 118. The antenna elements 112 include first elements 114 disposed at a first distance 116 from the center 118 along a circumference, second elements 124 disposed at a second distance 126 from the center 118 along the circumference, third elements 134 disposed at a first distance 136 from the center 118 along a circumference, fourth elements 144 disposed at a fourth distance 136 from the center 118 along the circumference, fifth elements 154 disposed at a fifth distance 156 from the center 118 along the circumference, sixth elements 164 disposed at a sixth distance 166 from the center 118 along the circumference, seventh elements 174 disposed at a seventh distance 176 from the center 118 along the circumference, eighth elements 184 disposed at an eight distance 186 from the center 118 along the circumference, ninth elements 194 disposed at a ninth distance 196 from the center 118 along the circumference, tenth elements 204 disposed at a tenth distance 206 from the center 118 along the circumference, and eleventh elements 214 disposed at an eleventh distance 216 from the center 118 along the circumference. Although eleven sets of the antenna elements 112 are shown in FIG. 1, other numbers of circumferential sets of antenna elements 112 can be utilized.

As shown in FIG. 1, the distance between neighboring elements 114, 124, 134, 144, 154,164, 174, 184, 194, 204, and 214 decreases the closer the element is to the center 118 in some embodiments. The elements 114, 124, 134, 144, 154, 164,174, 184, 194, 204, and 214 are smaller in area (e.g., effective area) the closer the element is to the center 118 in some embodiments. Such a configuration of spacing and element sizes provides for the dense pattern of the antenna elements 112 in some embodiments. The number of the elements 114, 124, 134, 144, 154, 164, 174, 184, 194, 204, and 214 at the respective distances 116, 126, 136, 146, 156, 166, 176, 186, 196, 206, and 216 can be any number from 4 to N where N is an integer in some embodiments. The number of the elements 114, 124, 134, 144, 154, 164, 174, 184, 194, 204, and 214 at the respective distances 116, 126, 136, 146, 156, 166, 176, 186, 196, 206, and 216 can be different from each other in some embodiments. The total number of elements (e.g., 303 in as shown in FIG. 1) varies according to system criteria and operational parameters.

The layout for antenna elements 112 is provided as a wavelength scaled array (WSA) (e.g., a continuously scaled circular WSA aperture) in some embodiments. The layout can be optimized with respect to size as the antenna elements 112 are provided more densely near the center at 118 in some embodiments. In addition, the spacing between the antenna elements 112 associated with the layout can be changed to provide maximum density in some embodiments in some embodiments. A wavelength scale parameter can define the pattern for the array 110 and is indicative of a wavelength scale factor (e.g., a lattice relaxation factor) indicating relaxation of antenna spacing (or relaxation of antenna spacing constraints) in some embodiments. In some embodiments, the antenna elements 112 near the center 118 are configured for higher frequency radio frequency signals and the antenna elements 112 farther from the center 118 are configured for lower frequency RF signals. In some embodiments, the antenna elements 112 in the centermost region of the array 110 are configured to cover the entire operational bandwidth, the antenna elements 112 in the region next tom the centermost region are configured to operate in a sub band below the highest portion and above the lowest portion of the operational bandwidth, and the antenna elements 112 at the periphery are configured to operate at the lower portion of the operational bandwidth. The wavelength scale parameter can indicate a density of the antennas of each band of the antenna system 100 as a function of position. For example, at least two adjacent antenna elements 112 of a first band can be spaced from one another by a first value of the wavelength scale factor, where the first value corresponds to the second frequency. Similarly, at least two adjacent antenna elements 112 of a second band can be spaced from one another by a second value of the wavelength scale parameter, where the second value corresponds to the third frequency. As illustrated in the various electronically scanned arrays described herein, including the antenna system 100, the spacing within bands can change in value from relatively inward bands to relatively outward bands. In some embodiments, the antenna elements 112 of each band have a half-wavelength spacing (e.g., the spacing amongst the antenna elements 112 of the first band is a half-wavelength, where the wavelength corresponds to the first frequency i.e. wavelength=c/first frequency, where c=speed of light).

The values of the wavelength scale parameter can correspond to the positions of the antenna elements 112 along with the frequency of the band. In a Cartesian coordinate system, the value of the wavelength scale parameter can be a function of frequency, element excitation, and/or element delay (or phase) for a particular antenna element 112 and can be a function of x, y, and frequency, where the antenna system 100 is configured as a planar array, and x- and y-refer to Cartesian coordinate dimensions. In a three-dimensional coordinate system, such as where the antenna system 100 is configured as a three-dimensional array—such as a conformal array configured to conform to a three-dimensional surface of an airborne platform or other platform—the value of the wavelength scale parameter can be a function of x, y, z, and frequency (or may be similarly determined in spherical or cylindrical coordinates as appropriate to the application). The wavelength scale parameter can be used to define a position of each antenna element 112 relative to a reference point, such as the center 118 of the antenna system 100, or a peripheral point. The wave length scale parameter can be calculated and the corresponding pattern can be provided according to the principles of U.S. patent applications Ser. No. 15/970781, filed by West et al. on May 3, 2018, incorporated herein by reference in its entirety.

Figure 5:
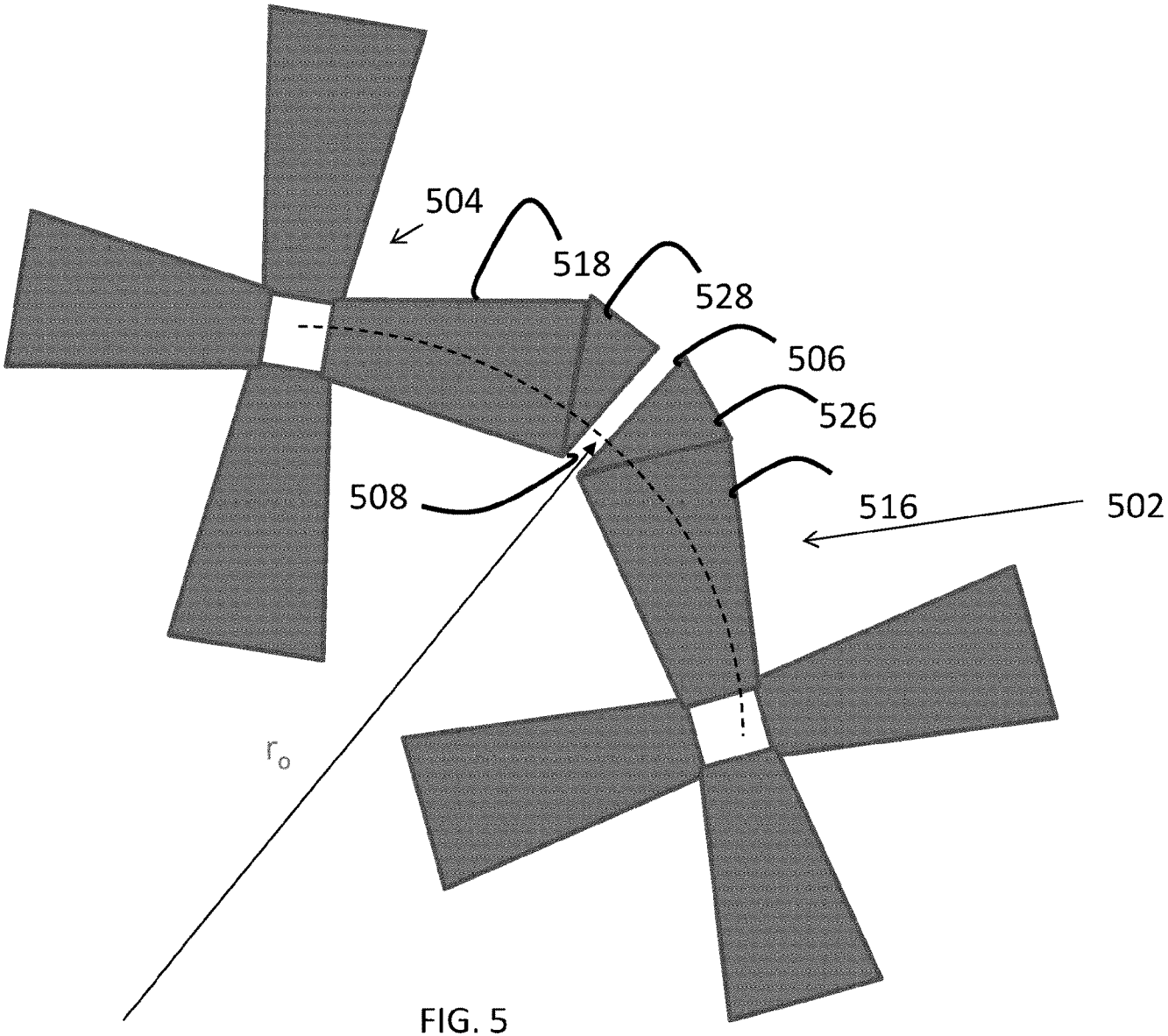
FIG. 5 is a top view schematic drawing of two bow tie of antenna elements for the antenna arrays illustrated in FIGS. 1 and 2 according to exemplary aspects of the inventive concepts disclosed herein.

In some embodiments, the antenna elements 112 are arranged in concentric circles. Other elements and element patterns are appropriate for a circularly symmetric WSA. In some embodiments, the elements 112 are arranged as multi-arm reactively load spirals. In some embodiments, the antenna elements 112 are cross bowtie dipoles which are end chambered to fit around a given circumference (FIG. 5). In some embodiments, the antenna elements 112 are any radiating element that intrinsically creates circular polarizations, for example, micro-strip patches or open ended quad ridged waveguides.

An antenna element 230 of appropriate size is used as each of the antenna elements 112 (e.g., elements 114, 124, 134, 144,154,164,174, 184, 194, 204, and 214) in some embodiments. The element 230 can be configured as an arched dual linear dipole (ADLD) radiating element in some embodiments. The element 230 includes a first dipole element 232 and a second dipole element 234. The dipole element 232 is provided in a straight linear configuration, and the dipole element 234 is provided in a curved configuration in some embodiments. The dipole element 234 is provided along the circumference while the dipole element 232 is provided in a radial fashion with respect to the center 118 in some embodiments.

The antenna element 230 is provided on a printed circuit board in some embodiments. The dipole elements 232 and 234 are printed circuit board trace conductors in some embodiments. The antenna element 230 is provided using metal cutouts or other conductive structures in some embodiments. In some embodiments, the antenna elements 112 are provided on a single circuit board or on multiple circuit boards (e.g., tiles) that are joined together to form the antenna array 110. In some embodiments, the radially opposed symmetric ADLD element pairs (elements 232 and 234) can be generalized to other radiating element types.

The dipole elements 232 and 234 intersect or cross over each other at a midpoint 236 at a 90 degree angle (e.g., a tangent line 238 of dipole element 234 at the midpoint 236 is perpendicular to the dipole element 232) in some embodiments. The dipole element 234 is provided on a first layer of a circuit board and the dipole element 232 is provided on a second layer of the circuit board in some embodiments. In some embodiments, the dipole elements 232 and 234 intersect on a single layer of the circuit board. In some embodiments, the dipole element 234 is provided on the same circuit board level as the dipole element 232 but does not connect to the dipole element 232 and the segments associated with ends 244 and 246 are connected on a second level (e.g. through conductive vias).

The dipole element 234 is provided at a radius of curvature and is curved inwardly towards the center 118 in some embodiments. The distance from the dipole element 234 at the end 244 to the tangent line 238 is greater than the distance between the tangent line 238 at the midpoint 236 and the dipole element 234 and the same as the distance between the tangent line 238 and the end 246 of the dipole element 234 (as shown by vectors 249) in some embodiments. In some embodiments, radius of curvature is the same as the radius of curvature of the circumference upon which the element 230 is provided. In some embodiments, radius of curvature is greater than or less than the radius of curvature of the circumference upon which the element 230 is provided.

Figure 2:
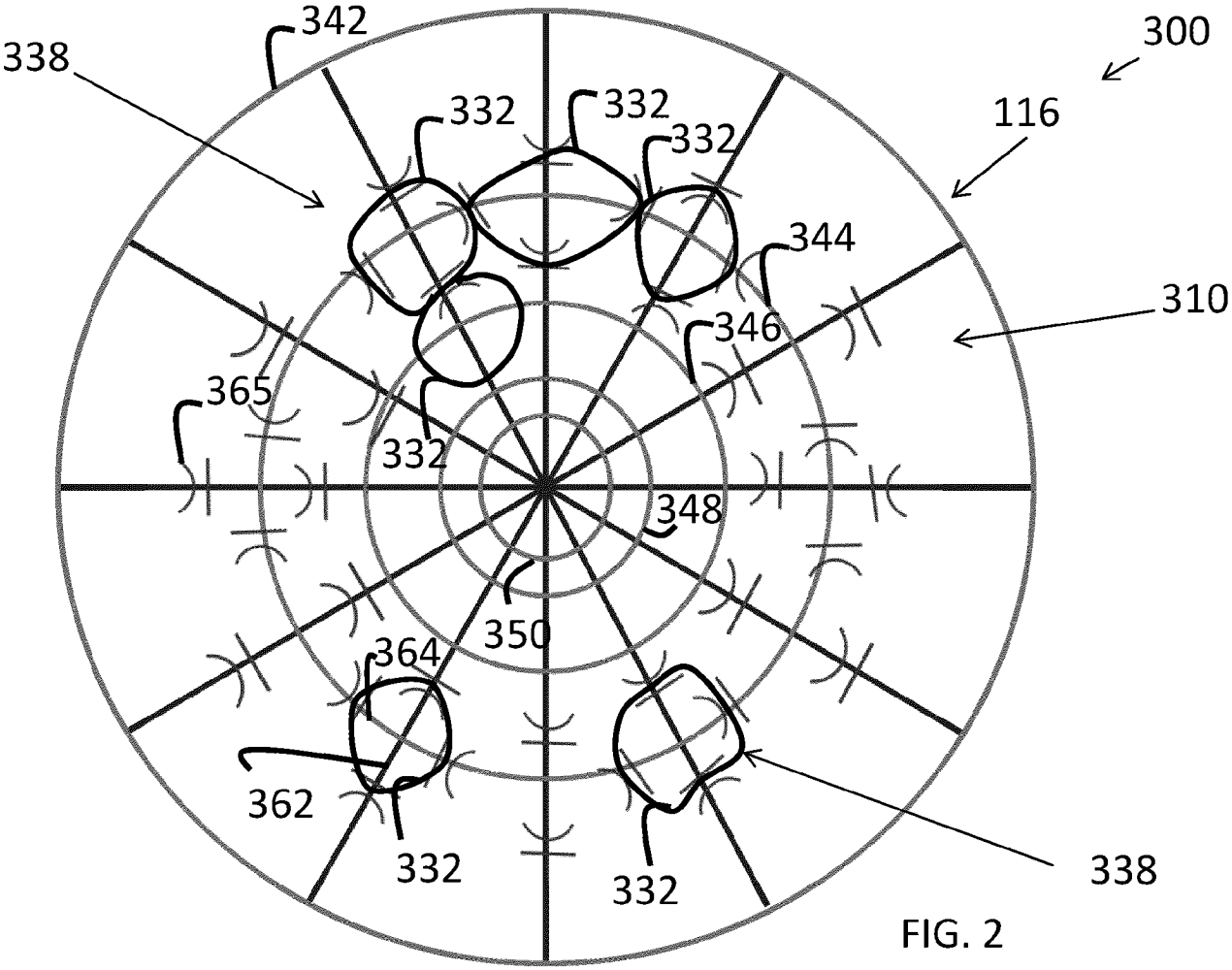
FIG. 2 is a top view schematic drawing of an antenna array with capacitive coupled elements according to exemplary aspects of the inventive concepts disclosed herein.

With reference to FIG. 2, an antenna system includes an array 310 which is similar to the antenna array 110. The antenna system 300 includes ADLD radiating elements 332 similar to the antenna elements 230 (FIG. 1). The ADLD radiating elements 332 are provided at different circumferences 342, 344, 346, 348, and 350. The radiating antenna elements 332 include a first dipole element 362 and a second dipole element 364 (similar to the dipole elements 232 and 234). The first dipole element 362 is radially disposed while the second dipole element 364 is bent about a constant radius and disposed along one of the circumferences 342, 344, 346, 348, and 350. The constant radius is the radius of the circumferences 342, 344, 346, 348, and 350 in which the second dipole element is disposed in some embodiments.

The radiating antenna elements 332 provide a cross-linear dipole that is distorted to fit within the circular configuration of the array 310. In isolation, each of the radiating antenna elements 332 does not have pure dual orthogonal (DOLP) polarization. However, the array 310 advantageously utilizes parasitic cross-polarization cancellation properties to achieve dual orthogonal linear polarization for the entire array 310. The radiating antenna elements 332 are provided sequentially and rotated about a circumference of the circumferences 342, 344, 346, 348, and 350 in opposing pairs such as the pair 338. The opposing pairs are 180° apart on the circumferences 342, 344, 346, 348, and 350.

The radiating antenna elements 332 are capacitively coupled to the four neighboring radiation antenna elements 332 as represented by the capacitor schematic symbols 365 in FIG. 2. Capacitive coupling occurs between the neighboring radiating antenna elements 332 in different circumferences 342, 344, 346, 348, and 350 and between the neighboring radiating antenna elements 332 within the same circumference of the circumferences 342, 344, 346, 348, and 350 in some embodiments. The array 110 is also has similarly capacitively coupled elements 112 (FIG. 1) in some embodiments.

Figure 3:
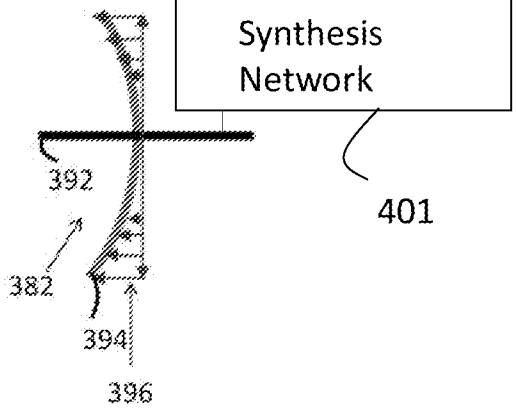
FIG. 3 is a top view schematic drawing of a pair of antenna elements for the antenna arrays illustrated in FIGS. 1 and 2 according to exemplary aspects of the inventive concepts disclosed herein.

With reference to FIG. 3, antenna elements 380 and 382 can be used as the antenna elements 112 (FIG. 1) or the antenna elements 332 (FIG. 2) and are paired for parasitic cross cancellation. The antenna element 380 includes an arched dipole element 384 and a linear dipole element 386, and the antenna element 382 includes an arched dipole element 394 and a linear dipole element 392. The antenna element 382 has a parasitic polarization component (e.g., represented by vectors 386 as a function of length for the arched dipole element 394), and the antenna element 380 has a parasitic polarization component (e.g., represented by vectors 392 as a function of length for the arched dipole element 384). The parasitic polarization components for the pair of the antenna elements 380 and 382 are diametrically crossed arch dual dipoles in a circular WSA configuration for the same radial distance from the epicenter so that they uniquely cancelled out in some embodiments. In some embodiments, the entire antenna systems 100 and 300 are provided with diametrically opposed pairs of antenna elements as a function of phi and radius that provide parasitic cross-polarization as shown in FIG. 3.

Figure 4:
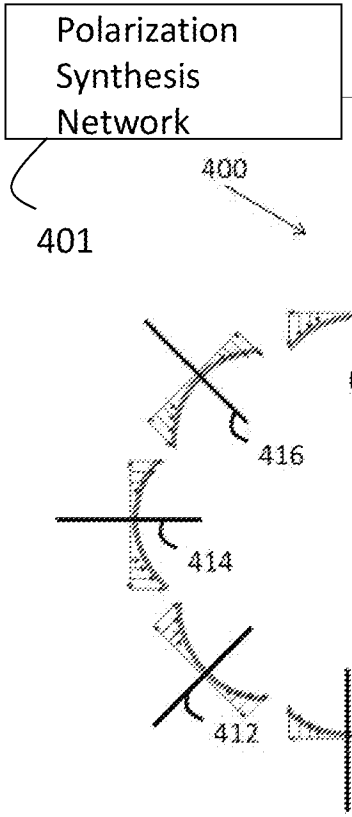
FIG. 4 is a top view schematic drawing of four pairs of antenna elements for the antenna arrays illustrated in FIGS. 1 and 2 according to exemplary aspects of the inventive concepts disclosed herein.

With reference to FIG. 4, a set 400 of antenna elements 402, 404, 406, 408, 410, 412, 414, and 416 are provided at diametrically opposite positions from each other and can be used in the antenna systems 100 and 300 in some embodiments. The pairs (elements 402 and 410, elements 404 and 412, elements 406 and 414, and elements 408 and 416) cancel out parasitic cross-polarization and each of the antenna elements 402, 404, 406, 408, 410, 412, 414, and 416 collectively functions as rotated DLP cross-dipoles within a circular array of environment for a given radius. Each concentric ring used in an array such as the antenna system 100 or 200 can have the same effect. Concentric rings (e.g., the circumferences 342, 344, 346, 348, and 350 in FIG. 2) of ADLD elements, such as the of antenna elements 402, 404, 406, 408, 410, 412, 414, and 416 at each different radii vectorially add by superposition to relative rotated elements, each with dual orthogonal linear polarization in some embodiments.

The right-hand and left-hand circular polarization (RHCP/LHCP) for the antenna systems 100 and 300 (FIGS. 1 and 2) is achieved with an ultra-wideband 90° phase shift between the dipole elements (e.g., dipole element 232and 234) within the DOLP pair (e.g., the antenna element 112) in some embodiments. The polarization rotation of each of the pairs of dipole elements can be configured a priori to provide relatively true DOLP. For example, the pair of antenna elements 404 and 412 and the pair of antenna elements 408 and 416 can be rotated by electronic adjustment to have vertical and horizontal polarization orientations. Polarization synthesis networks (PSN) 401 (FIG. 3) at each DLP can be used to generate arbitrary polarization at the radiating element.

With reference to FIG. 5, a pair of antenna elements 502 and 504 can be utilized as the antenna elements 112 (FIG.1) in some embodiments. The antenna elements 502 and 504 are arranged as crossed bow tie dipoles in a tightly coupled edge coupled array in some embodiments. Edges 506 and 508 of respective bow tie elements 516 and 518 are capacitively coupled. Chamber structures 526 and 528 of respective bow tie elements 516 allow dipoles centers to follow a circumference of constant radius in some embodiments. The dimensions (e.g., primarily length) of the bow tie elements 516 and 518 are adjusted to retune the element to compensate for the chamber structures 526 and 528 in some embodiments.

It will be appreciated that the various ESAs described herein, including the antenna system 100, may include varying arrangements of antennas (e.g., two-by-two; three-by-four; the second band may include multiple adjacent arrays. In some embodiments, providing the array of antennas includes providing a first circular array corresponding to the first design frequency and a second circular array corresponding to the second design frequency. At least a subset of antennas of the second circular array surrounds the first circular array. In some embodiments, the arrays of antennas are provided to form a three-dimensional array, which can be made conformal to a three-dimensional surface, such as a surface of an airborne platform.

The construction and arrangement of the systems and methods as shown in the various exemplary embodiments are illustrative only. Other numbers or types of antenna elements, other polarization configurations and other numbers or types dipole elements can be used. Although only a number of embodiments have been described in detail in this disclosure, many modifications are possible (e.g., variations in sizes, dimensions, structures, shapes and proportions of the various elements, values of parameters, orientations, etc.). For example, the position of elements may be reversed, flipped, or otherwise varied and the nature or number of discrete elements or positions may be altered or varied. Accordingly, all such modifications are included within the scope of the inventive concepts disclosed herein. The order or sequence of any operational flow or method operations may be varied or re-sequenced according to alternative embodiments. Other substitutions, modifications, changes, and omissions may be made in the design, operating conditions and arrangement of the exemplary embodiments without departing from the scope of the inventive concepts disclosed herein.

What is claimed is:

1. An antenna array, comprising:

a substrate having a surface;

a plurality of antenna groups circumferentially disposed on the surface about a center, the plurality of antenna groups including a first antenna group, the first antenna group including antenna elements disposed at a first distance from the center along a first circumference, each antenna element of the first antenna group including a first dipole element in a straight linear configuration provided radially with respect to the center, each antenna element of the first antenna group further including a second dipole element including a radius of curvature causing the second dipole element to curve inwardly towards the center;

wherein the antenna elements of the first antenna group are arranged on the surface to provide a wavelength scaled array based on an operative radio bandwidth; wherein each second dipole element includes a parasitic polarization component caused by the radius of curvature; wherein parasitic cross-polarization cancellation is provided for each second dipole element from a diametrically opposed second dipole element.

2. The antenna array of claim 1, wherein the radius of curvature of the second dipole is greater than the radius of the first circumference.

3. The antenna array of claim 1, wherein the radius of curvature of the second dipole is equal to the radius of the first circumference.

4. The antenna array of claim 1, wherein the radius of curvature of the second dipole is less than the radius of the first circumference.

5. The antenna array of claim 1, wherein each second dipole is capacitively coupled with two adjacent second dipoles of the first antenna group;

wherein each first dipole is capacitively coupled with an adjacent first dipole of a second antenna group with a larger circumference; wherein each first dipole is further capacitively coupled with an adjacent first dipole of a third antenna group with a smaller circumference.

6. The antenna array of claim 1, wherein the antenna elements are printed circuit board trace conductors.

7. The antenna array of claim 1, wherein the antenna elements are provided on circuit board tiles joined together to form the antenna array.

8. The antenna array of claim 1, wherein the first dipole element is phase shifted by ninety degrees from the second dipole element such that each antenna element is configured for at least one of right-hand or left-hand circular polarization.

9. The antenna array of claim 1, wherein a polarization synthesis network is coupled to each antenna element.

10. The antenna array of claim 1, wherein the antenna array includes rotationally symmetric radiation properties in a far field radiating zone.

11. The antenna array of claim 1, wherein the antenna array realizes an instantaneous bandwidth of at least a ten to one.

12. The antenna array of claim 1, wherein antenna elements for each of the plurality of antenna group are circumferentially disposed on the surface based on a wavelength scale parameter.

13. The antenna array of claim 12, wherein the wavelength scale parameter is indicative of the operative radio bandwidth for each antenna group of the plurality of antenna groups.

14. The antenna array of claim 12, wherein the wavelength scale parameter is indicative of a density the antenna elements of each antenna group of the plurality of antenna groups as a function of position.

15. The antenna array of claim 12, wherein the antenna elements of the first antenna group are spaced along the first circumference based on the wavelength scale parameter.

* * * * *